US005215072A

United States Patent [19]

Scott

[11] Patent Number: 5,215,072

[45] Date of Patent: Jun. 1, 1993

[54] CUTTING ELEMENT AND SAW CHAIN FOR CUTTING AGGREGATE MATERIAL

[75] Inventor: Lewis A. Scott, Lake Oswego, Oreg.

[73] Assignee: Blount, Inc., Portland, Oreg.

[21] Appl. No.: 878,412

[22] Filed: May 4, 1992

[51] Int. Cl.[5] ..... B28D 1/08

[52] U.S. Cl. ..... 125/21; 125/22

[58] Field of Search ..... 125/21, 22, 18, 15; 83/834, 830, 840, 844; 51/206.4, 206.5, 206 NF

[56] References Cited

U.S. PATENT DOCUMENTS

| | | | |
|---|---|---|---|
| 1,908,107 | 5/1933 | Bley | 125/22 |
| 2,869,534 | 1/1959 | Stihl | 125/21 |
| 3,593,700 | 7/1974 | McNulty | 51/267 |
| 4,546,755 | 10/1985 | Gustavsson | 125/21 |
| 4,637,370 | 1/1987 | Ishizuka | 125/15 |

FOREIGN PATENT DOCUMENTS

| | | | |
|---|---|---|---|
| 2245730 | 4/1974 | Fed. Rep. of Germany | 125/21 |
| 3413513 | 3/1985 | Fed. Rep. of Germany | 125/21 |
| 0045576 | 2/1989 | Japan | 51/267 |

*Primary Examiner*—Robert A. Rose
*Attorney, Agent, or Firm*—Robert L. Harrington

[57] ABSTRACT

A saw chain for cutting hard abradable material is shown and described. The saw chain cuts with an abrasive particle impregnated mesh structure. In one embodiment, the saw chain has right and left support links carrying the diamond mesh upon inclined support surfaces inclined relative to the travel axis of the saw chain. The abrasive particle impregnated mesh contacts the material to be cut only adjacent its trailing edge. A consumable material exists between the impregnated mesh and the support surface. The impregnated mesh may extend downward along the side of the support link to maintain a constant kerf width. In another embodiment, a formed cover is mounted on joined side link pairs of the saw chain. The cover has an abrasive particle impregnated mesh on an inclined surface and on select areas of its side skirts. The skirts cover as least a portion of the bores in the drive links and support links to retain and protect the fasteners therein.

10 Claims, 2 Drawing Sheets

CUTTING ELEMENT AND SAW CHAIN FOR CUTTING AGGREGATE MATERIAL

BACKGROUND INFORMATION

1. Field of the Invention

The present invention relates to saw chain cutting elements such as cutting links and in particular it relates to a cutting element and structure therefore for sawing hard, abrasive aggregate material.

2. Background of the Invention

Chain saws are efficient tools for cutting hard, abrasive material including aggregate materials such as formations of rock and stone, composite mixtures such as concrete, building blocks, brick and the like. Chain saws adapted for use on such aggregate materials take the general form of traditional chain saws as applied to wood products. The cutting elements of a saw chain for cutting hard abrasive material differ widely, however, from the traditional wood cutting saw chain.

The saw chains for cutting hard abrasive materials generally utilize rectangular cutting blocks mounted to support links of the saw chain. The cutting blocks are typically a matrix of material in which hard wear resistant cutting elements such as industrial diamonds are randomly distributed. The cutting blocks vary in several respects but generally are fixedly attached across a side link pair of the saw chain such as by weldments. Regardless of their configuration, they present a large surface area of the cutting block for abrading contact with the material to be cut, and the blocks are arranged so that the saw kerf produced exceeds the width of the basic chain chassis.

Cutting aggregate material is an abrading or crushing action rather than a severing, i.e., chip removal, action. The cutting blocks establish surface-to-surface contact with the material to be cut and the movement of blocks and pressure against the material reduces the material to fine particles. The aggregate material and the fine particles produced are very abrasive. The abrasive nature of this material inflicts severe wear conditions upon the saw chain components. The saw chain traveling in the kerf rubs against the side walls of the kerf, and this can rapidly wear away the saw chain rivet heads. A further problem is that the leading edge of the block produces the greatest cutting action and experiences the greatest wear. The area of the block succeeding the leading edge tends to inefficiently re-crush the material already removed, rather than productively remove additional material. The result is an inefficient use of the succeeding portions of the block.

Another problem with such cutting blocks, has been the uneven distribution of the cutting elements throughout the matrix. As the cutting block wears down, the number of exposed cutting elements, e.g., diamonds, can vary, i.e., more or fewer diamonds being exposed along one cutting area than another. Also, the leading and side edges of the block tend to erode or wear away at a faster rate than the rest of the block resulting in a crowned wear pattern. This crown makes it difficult to maintain the kerf width. As the blocks become tapered due to the crowned wear pattern, the chain can bind in the kerf. Kerf width is better maintained by removing the material in the corners of the kerf, but the corners of the cutting blocks tend to be the weakest part of the cutting block and often fail in this respect. Also, the corners of the kerf are not under the same constant cutting action as is the center portion of the kerf. This is due in part to assembly tolerance, i.e., lateral misalignment of individual blocks on the chain. A first block may be well centered on the chain and produce the desired kerf, but a succeeding block may be laterally offset. The outward extending corner of the offset block removes additional material, i.e., outside the desired kerf width, while the opposite corner does little or no cutting. Other blocks must remove the material skipped in the kerf corner by the offset block. Overall, the cutting block corners experience greater wear.

Accordingly, it is desirable that a saw chain for cutting aggregate material be better adapted to withstand the abrasion present in such cutting environments but with more efficient use of the abrasive particles, and better maintain a desired kerf width for improved cutting with less operator applied force. The subject matter of the present invention provides these and other advantages for an aggregate cutting saw chain.

Abrasive tools have heretofore included a diamond mesh cutting element whereby an underlying mesh structure receives a well distributed collection of hard particles, e.g., industrial diamonds, and the entire assembly is secured as a composite material by compression and sintering. Such composite material abrasive tools are shown and described in U.S. Pat. No. 5,049,165 issued Sep. 17, 1991 to Naum N. Tselesin, and entitled Composite Material; and in U.S. Pat. No. 4,925,457 issued May 15, 1990 to Peter T. deKok and Naum N. Tselesin and entitled Abrasive Tool and Method for Making. The disclosures of U.S. Pat. Nos. 4,925,457 and 5,049,165 are herewith incorporated fully herein by reference.

BRIEF SUMMARY OF THE INVENTION

In a first embodiment of the present invention, right and left cutting elements attach to a corresponding right and left support links. Each of the right and left support links are paired with a side link or tie strap. The cutting element is a mesh comprising abrasive material formed by uniformly distributing and securing hard, wear resistant particles, such as industrial diamonds, in the openings of a mesh. The cutting mesh is bonded to the support links by an adhesive agent such as industrial epoxy or by brazing. The bonding agent may also include a layer of wearable or consumable material to provide additional support for the cutting mesh on the support links.

According to one aspect of the invention, the mesh cutting element defines a surface inclined relative to the travel direction of the saw chain and has a formed section extending downwardly a short distance along the side of the support link. In the illustrated preferred configuration, only the trailing or top most edge of the mesh cutting element operatively engages the material to be cut. A formed guard extending upwardly from the front portion of the support link stabilizes the inclined surface of the cutting element. The guard portion of the support link includes a minimal surface area in contact with the material to be cut and wears away along with the mesh cutting element so that the guard does not impede the cutting action.

In a second illustrated embodiment of the present invention, the mesh cutting element is provided on the inclined top and on select portions of the depending skirts of a formed cover. The cover is secured to the side link pair by a bonding agent. The mesh cutting element portions on the sides of the cover maintain uniform kerf width. Also, it acts as a stabilizing surface riding against the side walls of the kerf.

As a further advantage, the cover fits over a side link pair of the saw chain with the depending skirts extending downwardly along each side of side link pairs to cover and retain headless fastening rivets that join the succeeding links. A headless fastener is disclosed in the concurrent and commonly assigned U.S. patent application Ser. No. 718,223 entitled Saw Chain Having Headless Fastener. This headless fastener does not extend beyond the side surface of the side links and avoids premature failure, i.e., by excess wear, of the fasteners. However, the headless fastener in the referenced U.S. patent Application relies on a formed section of the rivet, received in the center drive link, to retain the rivet in the assembled position. The rivet must be formed under close tolerances and must be forcibly pressed in place. In the present invention, the depending skirts eliminate the need for the formed section and thus simplify production of headless fasteners.

The inclination of the planar surface of the mesh, whether it is on a support link or the cover, applies only a relatively small area of the trailing edge of the mesh cutting element to the material to be cut. This reduces the area of contact between the material to be cut and the cutting element, and thereby reduces the force required to accomplish the cutting action. Also, the trailing edge withstands the impact forces within the kerf better than the leading edge. The mesh cutting element presents a row of abrading particles along this trailing edge for cutting across the width of the kerf and, because of the selected incline, a limited and consistent number of the abrading particles engage the aggregate material at a time. The selected inclination of the surface of the cutting element takes into account the configuration of abrasive particles of the cutting element including, generally, usable height of and spacing between the abrasive particles. Efficient utilization of the cutting element is thereby achieved.

The subject matter of the present invention is particularly pointed out and distinctly claimed in the following portion of this specification. Both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DESCRIPTION OF THE PREFERRED EMBODIMENTS

Figure 1:
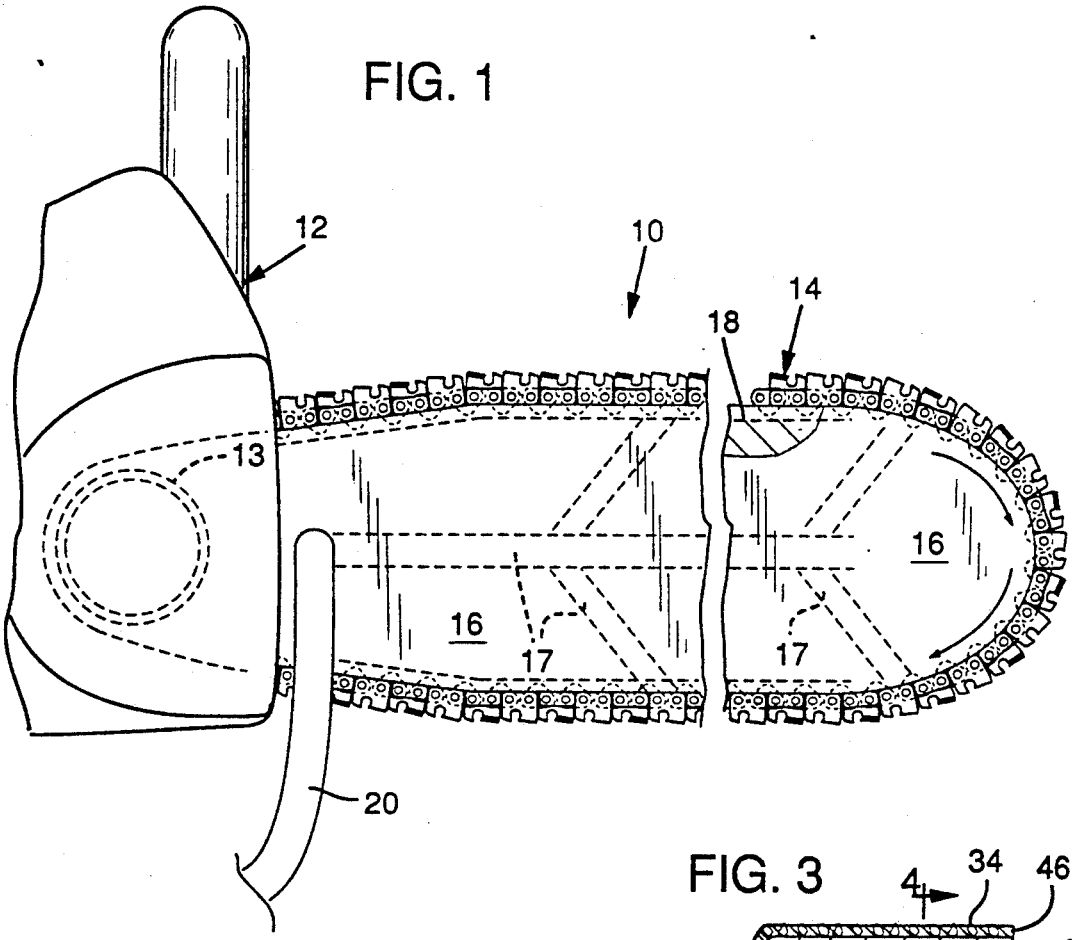
FIG. 1 is a side view of a chain saw suited for cutting hard abrasive material utilizing a saw chain according to a first illustrated embodiment of the present invention.

FIG. 1 illustrates a chain saw 10 adapted for cutting hard abrasive material. The chain saw 10 has a power head 12 transmitting power at its drive sprocket 13 to the saw chain 14 entrained around the sprocket 13 and guide bar 16. The guide bar 16 has internal channels and ports 17 to deliver a flushing and lubricating fluid to the guide groove 18 of the guide bar 16 and the saw chain 14 as carried within the groove 18. The fluid is supplied to the guide bar 16 via piping 20.

Figure 2:
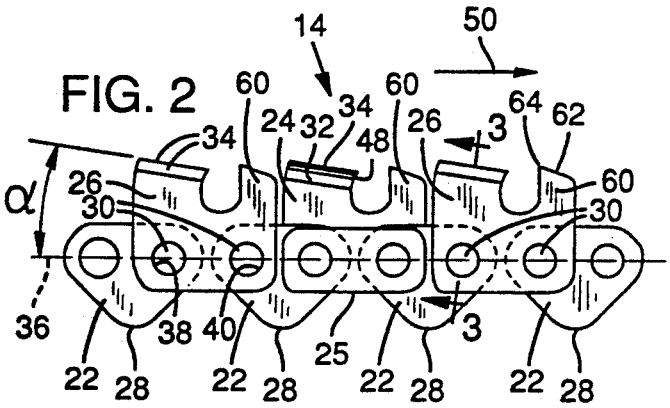
FIG. 2 is view of a section of the saw chain of FIG. 1.
Figure 3:
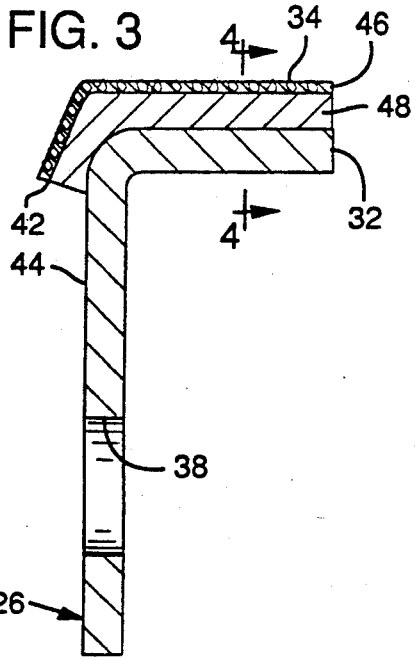
FIG. 3 is an enlarged view of the saw chain of FIG. 2 as taken along lines 3—3 of FIG. 2.
Figure 4:
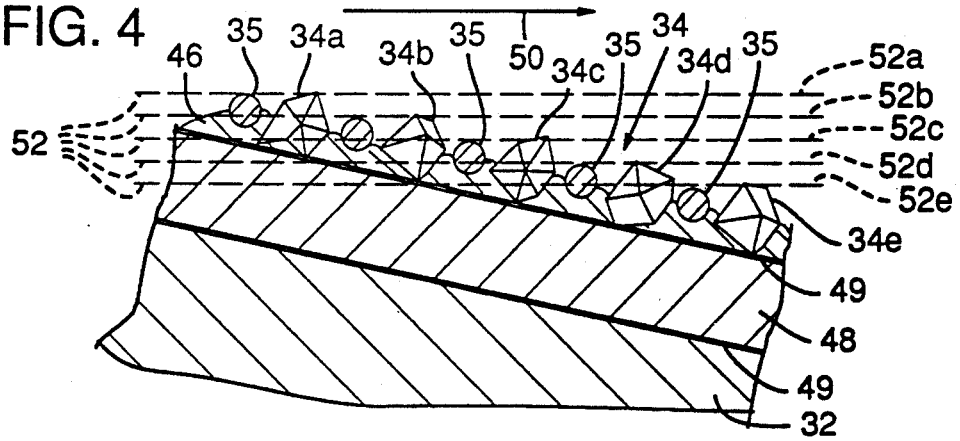
FIG. 4 is an enlarged view of the saw chain as taken along lines 4—4 of FIG. 3.

FIGS. 2–4 further illustrate the saw chain 14 of FIG. 1. FIG. 2 shows a short length section of the chain saw 14 and FIGS. 3 and 4 show sectional views of the saw chain 14. Chain 14 is assembled into an endless loop for entrainment on the guide bar 16 of the chain saw 10 of FIG. 1 in a conventional manner. The saw chain 14 has center drive links 22 pivotally connected to right hand and left hand support links 24, 26. The right hand and left hand support links 24, 26 alternate in sequence in conventional manner, with each support link 24, 26 paired with an opposing tie strap 25. The center drive links 22, the right and left hand support links 24, 26 and the tie straps 22 are suitably bored for receiving connecting fasteners 30, e.g., rivets. The center drive links 22 have tangs 28 engageable by the drive sprocket 13 of the chain saw 10 to propel the saw chain around the guide bar 16. The tangs 28 travel in the guide groove 18 of the guide bar 16.

The right and left hand support links are constructed in a manner generally similar to cutter links of conventional wood cutting saw chains. The following detail is for a right hand support link 26, but it is representative of the left hand support link 24 as well. The right hand support link 26 has a mesh cutting element 34 mounted on a formed top plate support structure 32. The support structure 32 is inclined at an angle $\alpha$ to an axis 36 (FIG. 2) extending through the fastener receiving bores 38, 40 in the support link 24 when the chain 14 is straight. In the illustrated embodiment, the angle $\alpha$ is on the order of 12 degrees, but may range between 8 and 30 degrees. The mesh cutting element 34 is thereby inclined relative to the travel path 50 of the chain 14 as it travels along the guide bar 16.

The mesh cutting element 34 is an abrading element formed by select placement of hard, wear resistant particles 34, diamonds in the preferred embodiment, organized as rows of particles 34*a*, 34*b*, 34*c*, 34*d*, and 34*e* in the openings of a wire mesh 35. The particles 34 are held in the openings of the mesh 35 by being at least partially embedded in a bonding agent 46, such as sintered metal powers. U.S. Pat. No. 4,925,457 issued May 15, 1990 to Peter T. deKok and Naum N. Tselesin and entitled Abrasive Tool and Method for Making, and U.S. Pat. No. 5,049,165 issued Sep. 17, 1991 to Naum N. Tselesin and entitled Composite Material show generally the method and structural characteristics of abrasive material formed by select placement of hard wear resistant particles in the openings of a mesh 35. The disclosures of U.S. Pat. Nos. 4,925,457 and 5,049,165 are generally applicable to the present invention as for the basic construction of a cutting element 34 and are incorporated herein fully by reference thereto.

In FIG. 3, the mesh cutting element 34 includes a portion 42 bent downward (as viewed in the figure) and extending outward slightly beyond the side edge 44 of the support link 26. The enlarged sectional view of FIG. 4 illustrates a preferred mounting arrangement of the mesh element 34 to the support 32, and an ideal wear pattern over the life of a first particle row 34*a* of element 34. The mesh cutting element 34 attaches by bonding agent 49, e.g., an industrial acrylic adhesive or the like, to a layer of consumable material 48 such as hard rubber or epoxy. The consumable material 48, in turn, is secured to the underlying support 32. The mesh 35 provides a base to which the hard particles, such as diamonds in the preferred embodiment, are bonded. In this embodiment, the mesh 35 is formed of a fine steel wire. In the alternative, the mesh cutting element 34 could be bonded directly to the support 32.

The mesh cutting element 34 is inclined relative to the travel path 50 of the chain 14 and with respect to the material to be cut. The mesh cutting element 34 presents its trailing edge, or top most edge in the view of FIG. 4, to the material to be cut. With only the trailing edge of the mesh cutting element 34 in abrading contact with the aggregate material a limited and consistent portion of element 34 abrades the material to be cut at any given time. This inclined relationship to the material to be cut remains as trailing edge portion of cutting element 34 wears away. The dashed lines 52 of FIG. 4 represent planes of the material to be cut, i.e., the base of the kerf as the cut progresses, and also indicate the wear pattern of the mesh cutting element 34.

As the mesh cutting element 34 wears at its trailing edge, some of the consumable material 48 following the cutting element 34 also wears away. However, it always leaves a next row of particles in abrading contact with the material to be cut. For example, the particles of row 34*a* are available to cut as the cutting element 34 wears away through the planes at reference numerals 52*a* and 52*b*. As row 34*a* wears away, the next forward row 34*b* comes into contact with the material to be cut and remains available through the planes 52*b* and 52*c*. Successively more forward rows 34*c*, 34*d* and 34*e* come into play, i.e., engage and wear away the material to be cut, as cutting element 34 further wears away through planes 52*d* and 52*e*. Since the underlying consumable material may be abraded away, it does not interfere with the cutting action of element 34, and it does provide structural backing for element 34 throughout abrasion thereof.

Referring again to FIG. 2, the chain 14 includes a tapered stabilizing guard portion 60 forward of the support 32 and the mesh cutting element 34. The guard 60 has a similarly inclined surface 62 that precedes the mesh cutting element 34. The inclined surface 62 of the guard 60 stabilizes the mesh cutting element 34 and prevents direct impact of element 34 with objects, e.g., reinforcing bar that may be present in the aggregate material. The pointed tip 64 at the trailing edge of the inclined surface 62 provides a minimal surface area in contact with the material to be cut. The tip 64 has a wear rate equal to or exceeding the wear rate of the mesh cutting element 34 so as not to interfere with the cutting action of the mesh cutting element 34. As a cutting force is applied to the cutting element, the stability of the cutting element is maintained by the guard 60. In this manner the guard portion 60 contributes to better stability of the cutting element 34 during operation, i.e., maintains the desired angular relation 10 between element 34 and the material to be cut.

The left hand cutter link 24 is similar to the right hand cutter link 26. The left hand cutter link 24 has the mesh cutting element 34 extending on the side of the link so that in the assembled chain 14 the mesh cutting elements 34 extend on each side of the chain 14 to produce a kerf width slightly wider than that of the basic chain chassis for protecting the fasteners 30. The left hand cutter link also has a guard portion 60 preceding the mesh cutting element 34.

Figure 5:
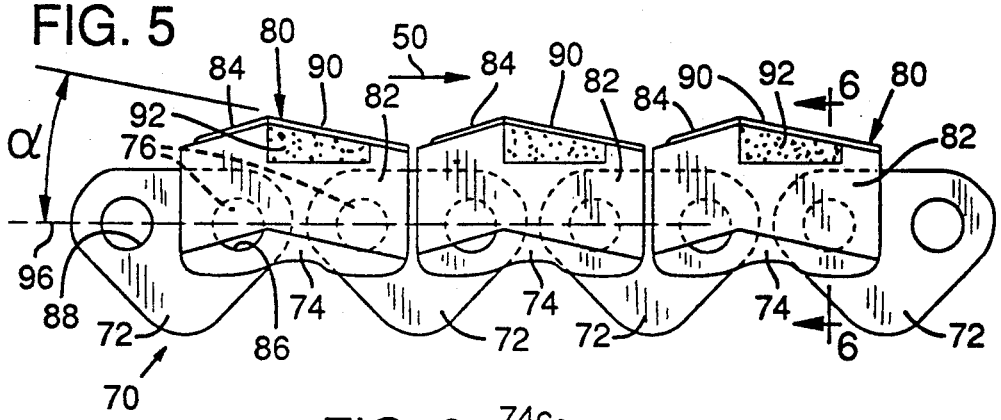
FIG. 5 is a side view of a saw chain according to a second illustrated embodiment of the present invention.
Figure 6:
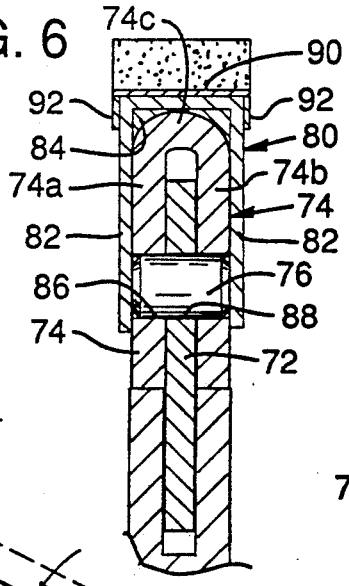
FIG. 6 is a sectional view of the saw chain of FIG. 5 as taken along lines 6—6 of FIG. 5.

In FIG. 5 a second embodiment of the present invention is a saw chain 70 also for use on the chain saw 10 of FIG. 1. The saw chain 70 has center drive links 72 pivotally connected to support links 74. The support links 74 are inverted U-shaped members having opposing spaced side portions 74*a* and 74*b* joined by top portion 74*c* as shown in FIG. 6. The support links 74 are pivotally joined to the center drive links 72 by straight shank fasteners or pins 76, fitting in bores 86, 88 of the support links 74 and the center drive links 72. The fasteners 76 are of a length to fit flush with the outer surfaces of the links 74.

A shaped cover 80 is fitted to the links 74 after the drive links 72 and the support links 74 have been pivotally joined in assembly by the insertion of the fasteners 76. The cover 80 has depending skirts 82 that extend downwardly on each side of the link 74 a sufficient distance to cover at least a portion of the bores 86, 88 in the link 74 and thereby retain the fastener 76 in the assembly. Because the cover 80 retains the fastener 76 within the bores 86, 88 the fastener 76 may be a simple straight shank element. As may be appreciated, a straight shank fastener reduces cost and makes assembly less complicated, i.e., no need to turn rivet heads or to press a center portion of the fastener into the drive link bore.

Cover 80 is produced with abrasive particles, e.g., diamond crystals, positioned in a wire mesh, at selected areas of its carrier. The carrier of the diamond mesh material, therefore, may serve as the basic structure of the cover 80. Surface 90 of cover 80 is provided with the mesh and abrasive particles over its entire surface. Each skirt 82 has select areas, indicated at 92, also provided with cutting elements. This configuration maintains the desired kerf width and, in addition, provides a stabilizing surface engaging the side walls of the kerf.

The cover 80 is fixedly bonded to the link 74 by a bonding agent 84 such as by an industrial adhesive or brazing. The bonding agent 84 fills the void between the top of the link 74 and the cover 80. The bonding agent 84 in addition to bonding the cover 80 to the link 74 provides added support and acts as a backup buffer for the cutting elements on the inclined surface 90 of the cover 80.

The cover 80 is mounted to the support link 74 with the surface 90 inclined relative to the axis of the chain travel path so that only the upper (in the view of FIG. 5) trailing edge of the surface 90 engages the material to be cut. More particularly, surface 90 is inclined at an angle o to an axis 96 extending through the fastener receiving bores 86, 88 in the support links 74. In this embodiment the angle $\alpha$ is preferably on the order of 12 degrees, but may range between 8 and 30 degrees. The cutting element thereby engages the material to be cut with a limited surface area and wears away in a manner similar to that illustrated in FIG. 4. The inclined surface 90 of the cover 80 tends to reduce damage due to impacts by its own ramping effect. The surface 90 also allows the chain 70 to better engage and pass by unusually resistent objects encountered in the material to be cut.

The links 74 with covers 80 may be positioned at each interval between succeeding center drive links 22 or they may be alternated with formed guards such as disclosed in the commonly assigned U.S. patent application Ser. No. 730,192 titled Saw Chain For Aggregate Material.

Figure 7:
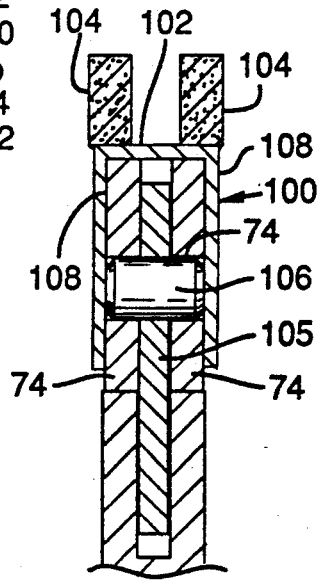
FIG. 7 is a sectional view of a cover mountable to a side link pair supporting conventional cutting blocks.

In FIG. 7, a cover 100 for use with side links 74 and having conventional diamond matrix cutting blocks 104 mounted thereon is shown. The cover 100 has an upper surface 102 on which cutting blocks 104 fixedly mount as by brazing. The cover 100 has depending skirts 108 that extend to cover the ends of the straight-shank fasteners 106, pivotally joining the drive links 105 and side links 74, and thereby secure fasteners 106 in place. The cover 100 is fixedly fastened to the side links 74 as by welding. The cutting blocks 104 are in turn affixed to the cover by weldments or adhesives.

Figure 8:
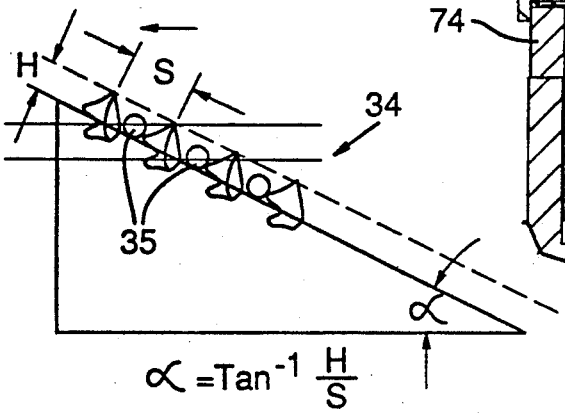
FIG. 8 illustrates selection of inclination for the mesh cutting element of the present invention.

FIG. 8 illustrates variation in the angle $\alpha$ as a function of the arrangement and character of the selected abrasive particles, e.g., diamonds in the illustrated embodiment. More particularly, abrasive particles are arranged on the wearable sloped surface of the diamond mesh cutting element 34 with reference to the usable height of and spacing between rows of the abrasive particles. By such arrangement, each row can be fully utilized in sequence during a sustained cutting operation for consistent cutting and maximally efficient use of the abrasive particles.

FIG. 8 illustrates a general model for the angle $\alpha$ and its relationship to the value H, the usable height of the abrasive particles, and to the value S, the separation between rows of abrasive particles. In FIG. 8, the effective cutting life or usable height of each particle is defined as the maximum amount of wear that an abrasive particle can sustain before its cutting function deteriorates and a new row of abrasive particles must engage the workpiece. Thus, the dimension H corresponds to that portion of the abrasive particle able to sustain an acceptable cutting or abrading ability as it wears during a cutting operation. As may be appreciated, this cutting function may be dependent upon the fragmentation characteristics of the selected abrasive particle. The dimension S represents a structural characteristic of the diamond mesh cutting element 34 corresponding to the diameter of the abrasive particles and the size of the wire mesh 35. The angle $\alpha$, i.e., the angle of the inclined surface of cutting element 34 relative to the axis 36 (FIG. 2) may be selected as:

$$\alpha = \mathrm{Tan}^{-1}\,(H/S)$$

In testing typical abrasive particles for wear characteristics, the value H may be approximately 0.005 inches and the value S approximately 0.020 inches. In this configuration, and according to the model of FIG. 8, the ideal design slope for such a cutting element 34 would be:

$$\alpha = \mathrm{Tan}^{-1}\,(0.005/0.020) = 14^\circ$$

By using an abrasive particle of the same general size but having a more frangible wear characteristic, the effective cutting life, i.e., the dimension H, may be increased to 0.010 inches. With the same structural spacing, i.e., 0.020 inches, the ideal slope of the cutting element 34 would be approximately 26.5 degrees. As may be appreciated by those skilled in the art, many variations in the angle $\alpha$ may be obtained by variation in the wear characteristics of the selected abrasive particles and in the particle organization, i.e., dimensions and relative spacing of the selected abrasive particles.

Accordingly, this controlled exposure of abrasive particles to the workpiece maximizes the overall wear life of the cutting element 34 because a minimum, but sufficient, number of abrasive particles are being worn away during a cutting operation at any given time. A consistent cutting action results.

It will be apparent to those skilled in the art that modifications and variations may be made without departing from the true spirit and scope of the invention. For example, the cutting element with its inclined mesh cutting surface herein described may be applied to a circular saw. Also, a variety of abrasive particles other than diamonds may be used in the cutting elements shown herein. The invention is therefore not to be limited to the embodiments described and illustrated but is to be determined by the appended claims.

What is claimed is:

1. A cutting element for a cutting tool for cutting a workpiece of abradable material, comprising;

a base portion and a cutting portion, said base portion adapted for attachment to a cutting tool and thereby defining a forward cutting direction, said cutting portion extended outwardly from said base portion and including a mesh having hard material-abrading particles aligned generally in rows extending transverse to the cutting direction, and a support supporting said rows of particles in an inclined plane extending outwardly and rearwardly relative to said forward cutting direction whereby each row of particles is supported from below and from behind as the row of particles is directed along said cutting direction while engaging and abrading said workpiece, and said support being a material that is softer than the particles whereby engagement of the support material with the workpiece induces wearing to maintain exposure of the particles.

2. A cutting element according to claim 1 wherein said cutting tool is a chain saw cutting tool and said cutting element resides on a saw chain of said chain saw.

3. A cutting element according to claim 1 wherein said inclined plane is oriented relative to said workpiece as a function of the organization of said particles so as to maintain a limited number of rows of said particles in abrading contact with said workpiece as said cutting element wears away in abrading said workpiece.

4. A cutting element according to claim 3 wherein said cutting element includes a stabilizing element contacting said workpiece and wearing away thereagainst so as to maintain a selected angular relation between said inclined plane and said workpiece.

5. A cutting element according to claim 3 wherein said limited number of rows is substantially one row such that as one row of particles wears away a next forward row of particles begins abrading contact with said workpiece.

6. A cutting chain comprising:

center links and side link pairs alternating in said cutting chain with a center link end positioned between the links of the side link pair, headless straight pivot pins extended through and pivotally connecting said center links and side link pairs front and rear in sequence and to each other; and an inverted U-shaped cover having an upper web portion extended over each side link pair and sides rigidly affixed to said web portion extended downwardly along the outer side of each link of said side link pair to cover the headless ends of said pivot pins to thereby retain said pins in position extended through the side link pair and intermediate center link end.

7. A cutting device for abrading a surface of an abradable material by use of a cutting element held against said surface, the cutting device comprising:

a cutting element and a drive arrangement for moving said cutting element in a forward direction along a surface to be abraded in a forward direction;

said cutting element defined by a collection of abrasive particles organized in adjacent rows transverse to said forward direction, the organization of rows residing in a given plane and the plane angled upwardly and rearwardly from said surface relative to said forward direction whereby each row of particles are positioned higher than the adjacent forward row; and said drive arrangement being movable to position the direction of travel adjacent and parallel to said surface while maintaining a selected angular relation between said given plane and said surface such that as said cutting element bears against said surface the particles of the rearmost row abrade the material in a cutting operation and also wear away in the cutting operation, said selected angular relation being a function of the organization of said abrasive particles whereby as said particles of said rearmost row wear away, the adjacent forward row of particles engage the surface to provide a limited and substantially consistent number of abrasive particles that engage the material at any given time.

8. The cutting device according to claim 7 wherein said selected angular relation takes into account the usable height of said abrasive particles in each row and the spacing between adjacent rows of said organization of abrasive particles whereby at least one row of said particles engages said material at a given time.

9. A cutting device for abrading a surface of an abradable material by use of a cutting element held against said surface, the cutting device comprising:

a cutting element defined by collection of abrasive particles organized in adjacent rows, the organization or rows residing in a given plane; and a drive arrangement for moving said cutting element along a direction of travel transverse to said rows of abrasive particles, the drive arrangement being movable to position the direction of travel adjacent and parallel to said surface while maintaining a selected angular relation between said given plane and said surface such that as said cutting element bears against said surface said particles abrade the material in a cutting operation and also wear away in the cutting operation, said selected angular relation being a function of the organization of said abrasive particles whereby as said particles wear away a limited and substantially consistent number of abrasive particles engage the material at any given time, and wherein said cutting element includes a stabilizing guard for contacting said surface of said material, wearing away along with said particles and maintains said selected angular relation between said given plane and said surface.

10. The cutting device according to claim 7 wherein said cutting element includes a consumable backing supporting said organization of abrasive particles and also wearing away with said particles.

* * * * *